United States Patent [19]

Imai

[11] 4,311,475

[45] Jan. 19, 1982

[54] COUNTER EJECTOR

[75] Inventor: Hiroto Imai, Fukuyama, Japan

[73] Assignee: Mitsubishi Jukogyo Kabushiki Kaisha, Japan

[21] Appl. No.: 107,083

[22] Filed: Dec. 26, 1979

[30] Foreign Application Priority Data

Dec. 26, 1978 [JP] Japan ..... 53-161679

[51] Int. Cl.[3] ..... B31B 1/64; B31B 1/98

[52] U.S. Cl. ..... 493/142; 271/218; 414/901

[58] Field of Search ..... 93/93 C, 93 DP, 93 R; 271/212, 189, 218, 279; 100/226; 493/142, 141, 143; 414/901

[56] References Cited

U.S. PATENT DOCUMENTS

| | | | |
|---|---|---|---|
| 3,150,578 | 9/1964 | Dale et al. | 93/93 DP |
| 3,203,561 | 8/1965 | Shields | 271/212 X |
| 3,557,667 | 1/1971 | Molla | 93/93 DP |
| 3,585,909 | 6/1971 | Carrel | 93/93 C |
| 3,679,072 | 7/1972 | Mueller | 93/93 DP X |
| 3,744,649 | 7/1973 | Ward, Jr. | 271/212 X |
| 3,834,290 | 9/1974 | Nelson | 93/93 C |
| 3,908,539 | 9/1975 | O'Brien | 100/226 X |
| 4,043,458 | 8/1977 | Schott, Jr. | 271/218 X |
| 4,162,649 | 7/1979 | Thornton | 271/218 X |

*Primary Examiner*—James F. Coan

*Attorney, Agent, or Firm*—Bernard, Rothwell & Brown

[57] ABSTRACT

A device for counting and delivering sheets which accumulates a plurality of paste-applied and folded cardboard sheets, delivered by a paste-applying and folding machine, in a hopper for delivery to a next step in batches of a prescribed number of sheets. A counter is employed to count the individual sheets as they are being accumulated in the hopper for further processing. A plurality of ledges reciprocal in a vertical direction and projectable into the sheets being accumulated in the hopper divide the sheets into batches of the prescribed number as a function of the sheets having been counted. The batches are then removed from the hopper and delivered to a binding machine which is adapted to bind the cardboard sheets as a next step.

7 Claims, 14 Drawing Figures

COUNTER EJECTOR

BACKGROUND OF THE INVENTION

The present invention relates to a method and apparatus for counting and delivering a plurality of paste-applied and folded cardboard sheets delivered by a paste-applying and folding machine of a cardboard box manufacturing apparatus, in the form of a plurality of successive batches each consisting of a prescribed number of said sheets, to a binding machine that is adapted to bind the cardboard sheets.

Typically, cardboard sheets are initially subjected to a paste applying and folding step before being counted and stacked into a batch having a prescribed number of sheets. The device employed as part of the counting and stacking operation is referred to herein as a counter ejector. Examples of known counter ejectors are the free drop type device as shown in FIG. 1 and an under-feed type device as shown in FIGS. 2 and 3.

Referring first to the free drop type counter ejector and delivering device shown in FIG. 1, a plurality of cardboard sheets 4 are delivered by conveyor rolls 1, 2 and 3 which constitute the delivery section of a paste-applying and folding machine of the preceding step. The sheets are then dropped and accumulated in a first hopper 5 where the sheets are squared by continuous reciprocating motion of squaring plate 6. Among the sheets 4 accumulated in the first hopper 5, the lowermost sheet 4 is conveyed by a suction conveyor 7 passing the lower end of the back stop 8 to a second hopper 9.

The sheets being delivered to hopper 9 are counted and arranged in a prescribed number of sheets for delivery to a binding step. For this purpose a photoelectric tube 10 counts the sheets 4 delivered to second hopper 9, and movable table 12 cooperates with side ledge 13 to divide the stacked sheets into the prescribed number for further processing. Specifically, sheets 4 carried by the suction conveyor 7 are counted one by one by a photoelectric tube 10 disposed at the inlet portion of the second hopper 9. As sheets 10 are delivered into second hopper 9 they are projected to strike front abutment 11 and are successively stacked on a table 12 which is movable up and down.

As the photoelectric tube counts a prescribed number of sheets, a side ledge 13 is projected to carry subsequent delivered sheets above the prescribed number. The batch consisting of a prescribed number of sheets stacked on the table 12 is then pushed forward toward a delivery conveyor 17 by means of a pusher 16 attached to a pair of chains 14 and 15. At this stage, the lower portion of the front abutment 11 is swung about a hinge 18 so as not to hinder the forward movement of the sheets 4.

Thus, in the free drop type device, the sheets are divided into batches while they are in the second hopper 9, so that the stacking and delivery of the sheets are conducted smoothly. In addition, since the sheets are counted one by one when they are discharged from the first hopper 5, the undesirable miscounting during stacking in the second hopper 9 is fairly avoided. On the other hand, however, this type of device poses various problems. For instance, since the arrangement is such that the sheets stacked in the first hopper are once released for counting and then divided into batches while they are in the second hopper, the length of the apparatus as a whole being inevitably long requires a large installation space and incurs a rise of the cost. In addition, since each sheet is set free when travelling between the first and the second hoppers, the sheet, which has been applied with paste and folded in the preceding step before the drying of the paste, exhibits a repulsive force to unfold while it is on the suction conveyor 7. As a result, the sheet cannot be delivered to the second hopper smoothly and may cause troubles such as jamming.

In the underfeed apparatus successive sheets are delivered beneath the accumulating stack rather than above the stack as in the free drop apparatus described above. As a result the batches formed are removed from the top of the stack for further processing. For facilitating the delivery of sheets and removal of the formed batches, a mechanism is provided which tends to move the accumulating sheets in an upward direction.

Referring now to the under-feed type device shown in FIGS. 2 and 3, the sheets 4 which have been applied with the paste and folded in the preceding step are delivered by conveyor 22 to conveyor 19 above which the sheets 4 are accumulated. A guide conveyor 20 is positioned relative conveyor 19 to engage a leading end of sheets 4 and force them upwardly. Conveyor 19 carries sheets 4 delivered to it in such a manner as to be pressed against a guide conveyor 20. At both sides of the outlet of the paste applying and folding machine, screws 21 and 21' are set in accordance with the width of the sheet. The folded sheet 4 is then received at its both sides by grooves of the screws 21 and 21' which are rotated in the direction to lift the sheet 4 received by their grooves. In consequence, the trailing end of the sheet 4 is gradually raised to facilitate the insertion of the leading end of the next sheet 4 thereunder. The guide conveyor 20 is driven in the upward vertical direction shown by the arrow in FIG. 3 at a low speed to facilitate entry of sheet 4 which is coming under the preceding sheet and to facilitate the lifting of the trailing end of the underlying sheet by the screws 21 and 21'. The sheets thus raised gradually are squared by a reciprocating movement of a squaring plate 23 and are further lifted gradually.

Disposed above these sheets thus lifted are chains 24 and 25 which have pushers 26 adapted to push the upper part of the pile of the sheets 4 toward delivery conveyor 27. The number of the sheets constituting the upper portion of the pile pushed by the pushers is determined by factors such as the ratio between the speed of operation of the paste applying and folding machine and the speed of chains. This ratio is usually changeable in about four stages.

As has been explained, this device has a simplified construction and requires only a small installation space. However, this construction suffers from a disadvantage in counting because the number of sheets constituting the batch forwarded by the pushers is determined by the height of the pile of the sheets the counting is made in an inaccurate manner. In addition, the surface of the sheets on which printing has been made in the preceding step may be stained during the forcible lifting of the sheets by the screws.

SUMMARY OF THE INVENTION

Thus, the present invention aims at providing a counter ejector, capable of accurately grouping the sheets into batches in a more efficient and smooth manner than the conventional devices, thereby to overcome the above stated problems of the prior art.

Under these circumstances, the present invention provides a device for accumulating, in a hopper, a plurality of paste applied and folded sheets delivered by a paste applying and folding machine and delivering the sheets to the next step in batches of a prescribed number of sheets. A plurality of ledges, movable up and down and projectable, project and divide the sheets into batches of the prescribed number of sheets.

In the sheet counting and delivering device of the invention having the above described construction, the cardboard sheets delivered by the paste applying and folding machine are counted at the hopper inlet and are stacked in the hopper. As the prescribed number of sheets are counted, the ledges are successively projected into the hopper to receive and carry the subsequent sheets. At the same time the ledges are lowered to press the underlying batch of sheets until the batch is delivered to the next step. Simultaneous with the lowering of these ledges, other ledges are lifted from the lower position to prepare for the next dividing of the sheets. As the batch of the prescribed number of sheets is delivered to the next step, the ledges which have pressed the upper face of the batch are extracted from the hopper to prepare for the next operation cycle.

According to the invention, the plurality of ledges and the operation cycle of each ledge as described make it possible to count and deliver in the same hopper, thereby ensuring an efficient and smooth counting and delivery of the sheets. Further, the grouping of the sheets into batches is made in an accurate way, because it is achieved by ledges adapted to operate in response to the counting made at the hopper inlet.

Hereinafter, the description will be made in more detail with reference to FIGS. 4 to 14 showing preferred embodiments of the invention.

DETAILED DESCRIPTION OF THE PREFERRED EMBODIMENT

Figure 1:
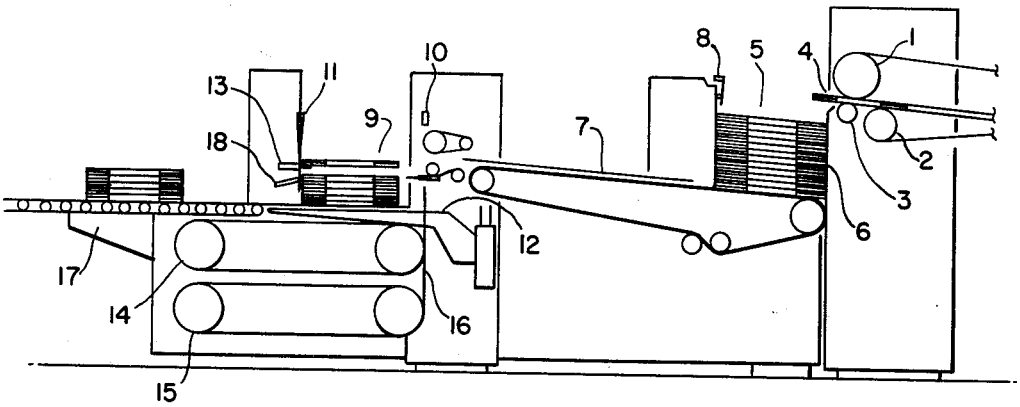
FIG. 1 is a schematic illustration of a conventional counter ejector of free dropping type.

Referring to FIGS. 4–12, a photoelectric tube 53 and a counter (not shown) adapted to detect the passage of a prescribed number of sheets 4 are disposed at the outlet of a paste applying and folding machine 52. A hopper section 28 includes a front abutment 31 for stopping the sheets 4 conveyed by delivery conveyors 29 and 30. A squaring plate 32 is spaced rearwardly from front abutment 31 and adapted for a continuous reciprocating motion in the direction of delivery of the sheets. For receiving sheets 4, a table 33 is provided for reciprocal movement in the vertical direction between front abutment 31 and squaring plate 32. A blower 34 is disposed above hopper section 28 to promote and facilitate the dropping of the delivered sheets 4.

Sheet engaging members, 35 and 36 which in the embodiment are ledges, are disposed behind squaring plate 32. Each of the ledges is arranged for movement reciprocally in the vertical direction and projectable into the hopper 28 along and through a vertical slit formed in the squaring plate 32 at the breadthwise central portion of the latter. Disposed beneath the hopper section 28 is a pusher 39 which is adapted to push successive batches of sheets 4 from table 33, when the latter is in a lower position beneath front abutment 31 and squaring plate 32 as shown in phantom lines of FIG. 4, toward delivery conveyors 37 and 38.

Figure 5:
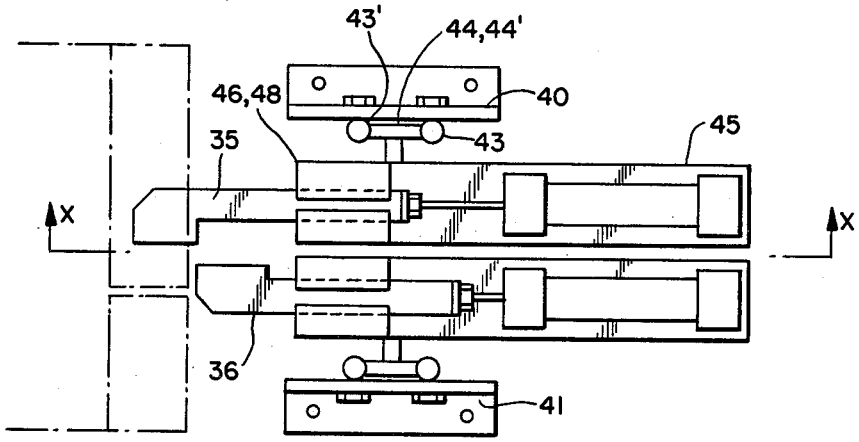
FIG. 5 is a plan view of the ledges incorporated in the device shown in FIG. 4.
Figure 6:
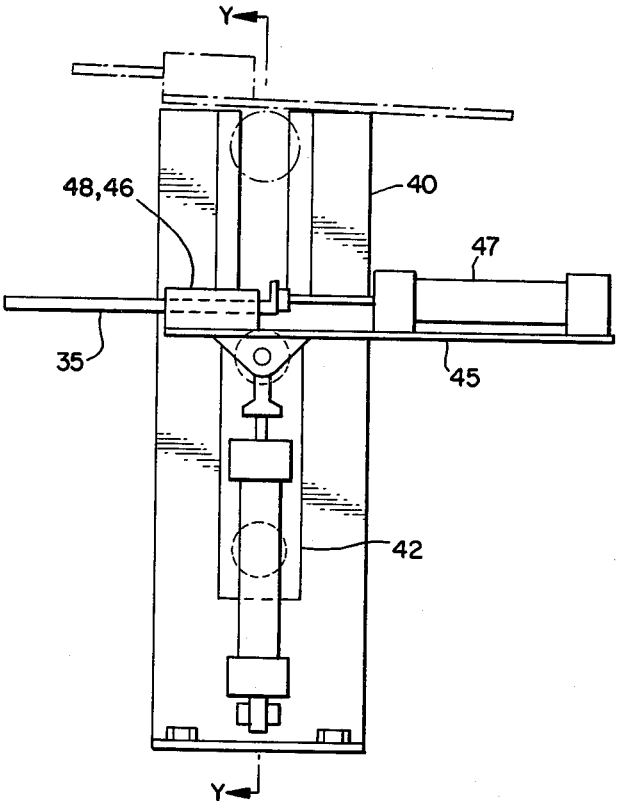
FIG. 6 is a front elevational view of the part of the device shown in FIG. 5.
Figure 7:
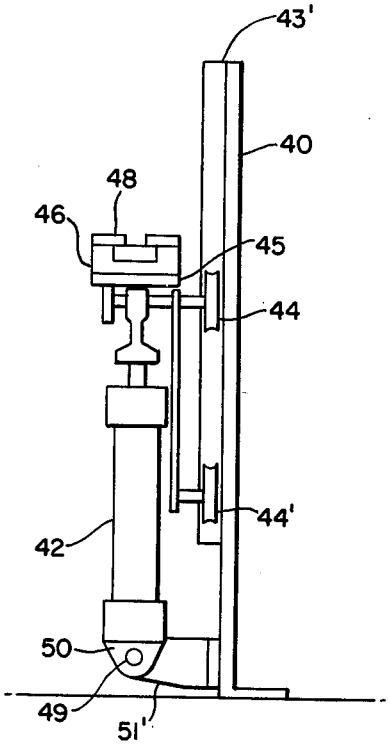
FIG. 7 is a side elevational view of the part of the device shown in FIG. 5.
Figure 8:
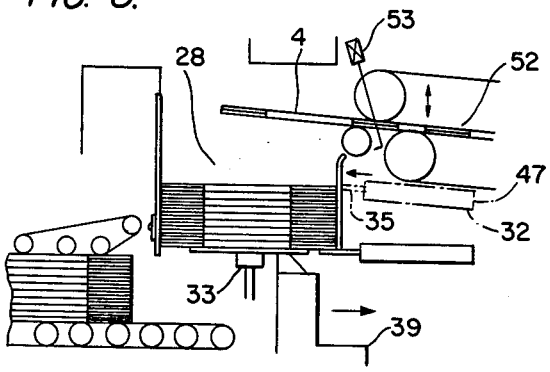
FIGS. 8 to 12 are illustrations of operation of the first embodiment of the invention.

Referring now to FIGS. 5 and 7 showing the construction of the ledges 35 and 36, the first ledge 35 is arranged in symmetry between laterally spaced frames 40 and 41 and has identical construction to but is spaced from second ledge 36. Ledge 35 and related apparatus is carried on its respective ledge frame 45 which is moved vertically relative to frames 40, 41. The first ledge 35 is received by a guide section 46 of ledge frame 45 and is connected to the end of a rod of a pneumatic cylinder 47 which is fixed to the upper face of the ledge frame 45, so as to be slidingly moved with respect to the guide section 46. The first ledge 35 is prevented by cover or abutment plate 48 from being disengaged from the guide section 46. A lifting pneumatic cylinder is arranged beneath frame 45 for reciprocally moving the ledge 35 in frame 45 in the vertical direction. The ledge frame 45 is connected to an end of a rod of the lifting pneumatic cylinder 42. Lower portion of the lifting pneumatic cylinder 42 has connecting bearing 50 which is in turn fixed to the bracket 51 extending from frame 40 by means of pin 49.

Ledge Frame 45 is L-shaped in configuration where the shorter leg of the "L" supports pneumatic cylinder 47 and the longer leg of the "L" extends downwardly between cylinder 42 and frame 40. Vertical guide rollers 44 and 44' are attached to the longer leg constituting a part of the ledge frame 45, and are received by guide rods 43 and 43' attached to the frame 40. In this embodiment the guide rods 43, 43' extend vertically in spaced relationship a distance approximately equal to the diameter of guide rollers 44, 41' and each guide has a recessed periphery for engaging the rods 43, 43' in a tongue and groove relationship. This system provides a means to guide the vertical movement and to maintain the correct inclination of the ledge frame 45.

The second ledge 36 has the same construction as the first ledge 35 and is arranged in symmetry with the latter. The description of the second ledge would be largely redundant and is therefore omitted.

The device of the first embodiment having been described with respect to construction operates in a manner described hereinunder with reference to FIGS. 8 to 12.

It is assumed here that one batch of the sheets consists of 10 sheets. The sheets delivered by the paste applying and folding machine 52 of the preceding step to the hopper 28 are counted and stacked on the liftable table 33 by a batch, i.e., ten sheets, while being trued up by the squaring plate 32. As the next sheet, i.e., the 11th sheet is detected and counted by the photoelectric tube 53 and the counter, the cylinder 47 is actuated to commence the insertion of the first ledge 35 into the hopper 28. This state is well shown as FIG. 8.

Figure 9:
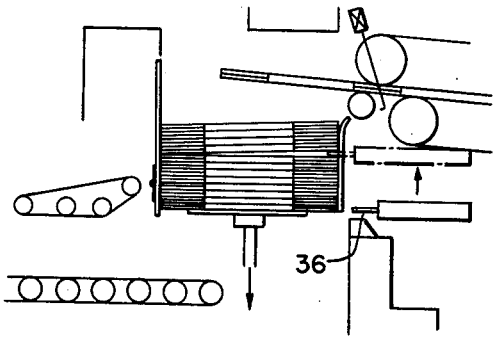

As the first ledge 35 is inserted, the subsequent sheets starting from the 11th sheet are stacked on or above the inserted first ledge 35. Simultaneously, the liftable table 33 starts to move downward. Also, the first ledge 35 is moved downward by the action of the lifting cylinder 42. Meanwhile, the second ledge 36 starts to move upward. This state is shown in FIG. 9.

Figure 10:
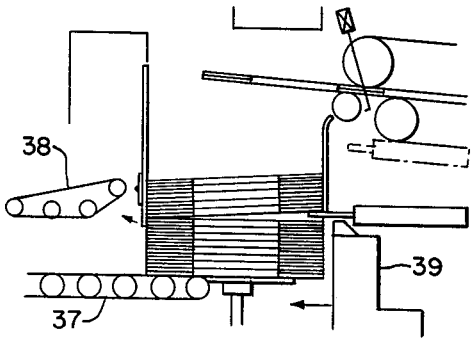
Figure 11:
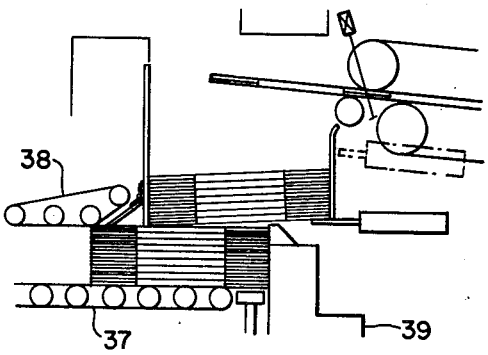

As the table 33 and the first ledge 35 reach the lower limits of their strokes, the pusher 39 is actuated to start to push one batch of the sheets from the inside of the hopper toward the conveyers 37 and 38. This state is shown in FIG. 10. The batch of the sheets is pushed by the pusher 39 to the gap between the upper and lower conveyors 37 and 38 and delivered to the next step with the leading edges of the sheets clamped between the conveyors. Meanwhile, the next batch of the sheets is supported by the first ledge 35 and the pusher 39. This state is shown in FIG. 11.

Figure 12:
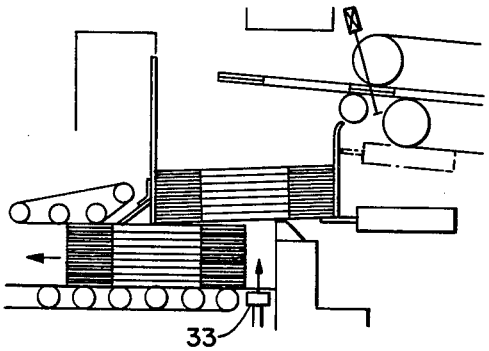

A batch of sheets is conveyed by the delivery conveyor and passes the table 33. After cleared completely by the batch of sheets delivered to conveyors 37 and 38, the table 33 starts to move upward toward the starting position. This state is shown in FIG. 12. As the table 33 reaches the upper limit of the stroke, the first ledge 35 and the pusher 39 are returned to the starting positions to resume the state shown in FIG. 8.

The described cycle of operation is thereafter repeated. It is to be noted, however, that the first and the second ledges 35 and 36 operate alternatingly in successive cycles of operation. The instruction for successive steps of operation are given automatically by a known automatic controller which is not shown.

As has been described, in this embodiment, the sheets are grouped by two ledges which operate alternatingly in the same hopper, into successive batches of a prescribed number of sheets, and are delivered in batches. As a result, the size of the ledges can be reduced and the operation of the ledges can be made with sufficient margin of time. In addition, the size of the device as a whole can be made smaller as compared with the conventional device of 2-stage type. For these reasons, according to the invention, it is possible to simultaneously achieve both of increased speed of work and the lowered cost.

In addition, since the sheets stacked on the table is continuously depressed by the blower or ledge, the undesirable spring back of the sheet is fairly avoided to eliminate the troubles in the delivery of the sheets.

Further, since the sheets are counted one by one during the accumulation, the unfavorable miscounting of the sheets, which has been often experienced in the conventional device of the under-feed type, is eliminated. Also, the staining of the printed surface, which is inevitable in the conventional under-feed type device, is avoided because there is no relative sliding movement between successive sheets during stacking of the sheets.

Figure 2:
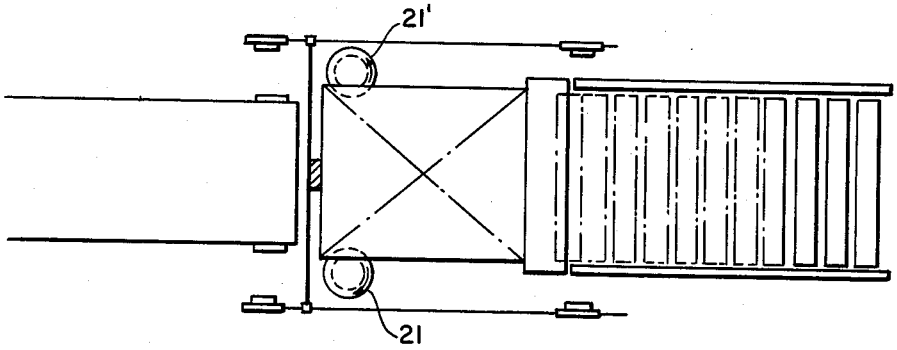
FIG. 2 is a schematic illustration of a conventional counter ejector of under-feed type.
Figure 3:
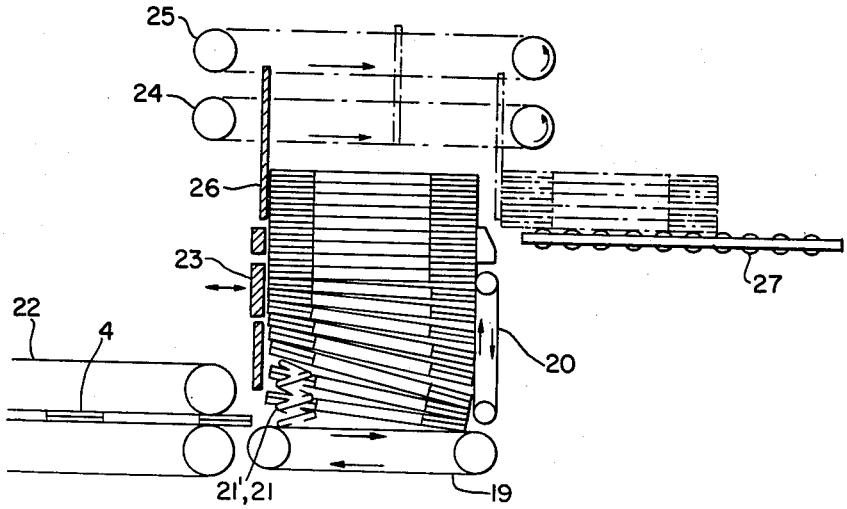
FIG. 3 is a front elevational view of the device shown in FIG. 2.
Figure 4:
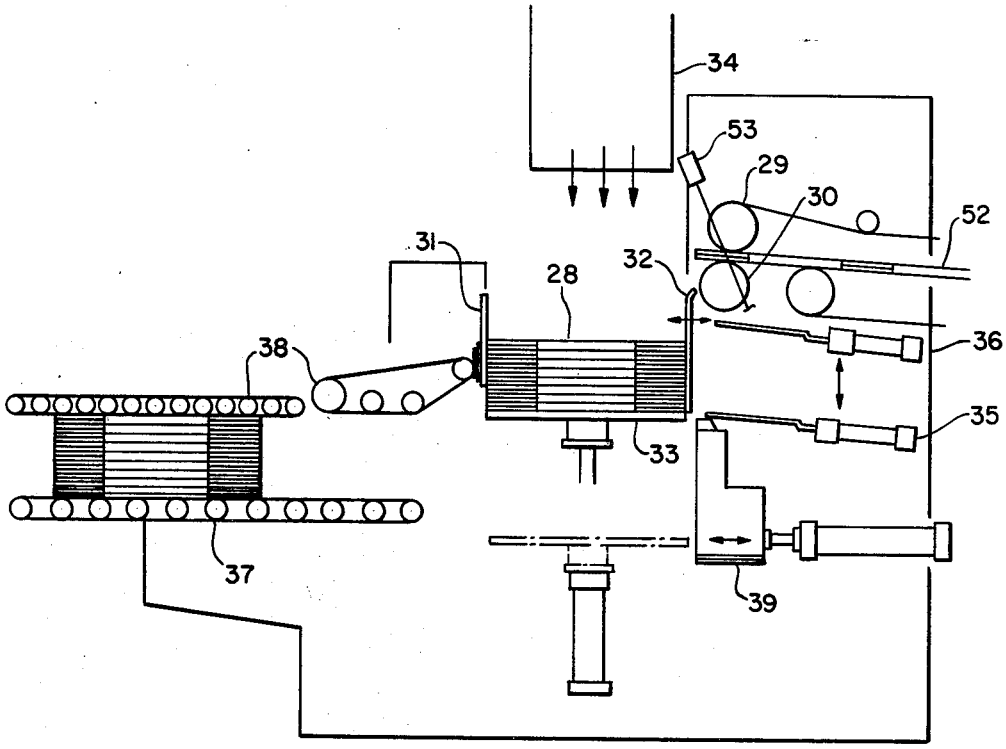
FIG. 4 is a front elevational view of the whole part of a counter ejector constructed in accordance with the first embodiment of the invention.

Hereinafter, a second embodiment of the invention will be described with specific reference to FIGS. 13 and 14. This embodiment is applied to the under-feed type device as shown in FIGS. 2 and 3.

A photoelectric tube 54 for counting the sheets is disposed at the inlet of the hopper 58. Ledges 55 and 55' are mounted for alternating free vertical swinging motion about the pivots 56. The ends of the ledges 55 and 55' are projectable into the hopper. The swinging motion of the ledges 55 and 55' is effected by cylinder means which are not shown, but may be similar to the cylinder means shown in FIG. 6.

The pusher 57 is adapted to eject the sheets on the ledges when the latter are in positions near the upper ends of their strokes, making a contact with the upper surfaces of the ledges 55 and 55'. The engagement of pusher 57 with the ledges 55, 55' prevents sheets accumulated beneath the batch of sheets being ejected from being inadvertently removed from the hopper.

In operation of the second embodiment having the described construction, the sheets delivered by the paste applying and folding machine 22 are counted by the photoelectric tube 54 before they enter the hopper 58. As the hopper 58 is supplied with a prescribed number of sheets, one of the ledges 55 and 55' is inserted to separate the sheets from the succeeding sheet. Then, as the sheets are supplied successively, one of the ledges 55 and 55' is moved upward together with the sheets 4, while the other ledge is lowered to prepare for the next dividing operation. As the ledges 55 and 55' are moved to a point near the upper end of the stroke, the batch of the sheet on the ledges is ejected by the pusher 57 which is rotating at a constant speed. This cycle of operation is repeated to deliver successive batches of a prescribed number of sheets to the next step.

Figure 13:
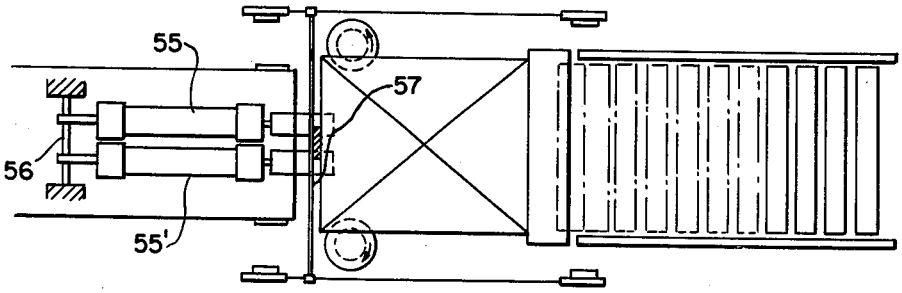
FIG. 13 is a schematic illustration of a second embodiment of the invention.
Figure 14:
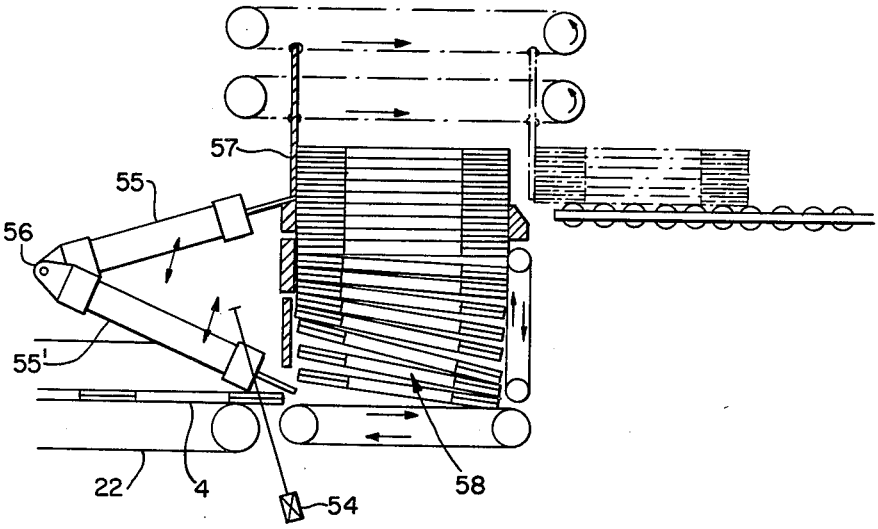
FIG. 14 is a front elevational view of the device shown in FIG. 13.

Although in this second embodiment as shown in FIG. 13 screws are employed to engage and lift successive sheets, such construction is not necessary with the ledges 55 and 55'. Rather the action of the ledges themselves, as shown in FIG. 14, can be employed to engage and lift or raise the trailing end of the sheets and facilitate insertion of the leading end of the next succeeding sheet. By eliminating the screws in this manner the associated problem of staining the printing is overcome in the underfeed device. Thus, the ledges serve a dual function of facilitating accumulation and dividing sheets into batches.

Thus, also in this embodiment, the sheets are counted by one by the photoelectric tube and are grouped into batches by the ledges at each time the prescribed number is counted, the batch on the ledge being then forwarded to the next step. Therefore, the sheets are counted quite accurately and the work can be done highly efficiently.

I claim:

1. An apparatus for accumulating and ejecting sheets of paste applied and folded cardboard comprising a hopper, means for accumulating a plurality of said sheets in said hopper, means for delivering said sheets in batches of a prescribed number from said hopper to a next step, a plurality of sheet engaging members, means for alternately reciprocating said engaging members in a vertical direction and alternately projecting said engaging members between said sheets in said hopper to successively project and divide said sheets into batches of said prescribed number and; said means for alternately reciprocating and projecting said engaging members being operable to press an underlying batch of sheets downwardly during a downward portion in the vertical direction taken by said engaging members when reciprocated.

2. The apparatus according to claim 1 wherein said means for alternately reciprocating and projecting said engaging members includes fluid cylinder means connected to said sheet engaging members.

3. The apparatus according to claim 2 wherein said engaging members include a first and second engaging member and said cylinder means includes a first cylinder member for projecting said first engaging member between said sheets and a second cylinder member for projecting said second engaging member between said sheets, a third cylinder member for moving said first engaging member and first cylinder member reciprocally in the vertical direction, and a fourth cylinder member for moving said second engaging member and said second cylinder member reciprocally in the vertical direction alternating with the reciprocal movement of said third cylinder member.

4. The apparatus according to claim 3 including a counter for counting individual sheets being delivered to said hopper and control means for alternately causing said cylinder members to reciprocate in the vertical direction and to project between said sheets to divide said sheets into batches in said prescribed number as defined by said counter.

5. The apparatus according to claim 4 wherein said third and fourth cylinder members have a stroke for moving said first and second cylinder members between upper and lower vertical positions, and said first and second cylinder members having a stroke for moving said first and second engaging members between an extended and retracted position, said control means including means for alternately actuating said third and fourth cylinder members to extend said engaging members at said upper position and retract said engaging members at said lower position.

6. The apparatus according to claim 5 including a table arranged for vertical reciprocal movement beneath said hopper to receive said accumulated sheets, said table having a stroke between an upper position where said sheets are accumulated and a lower position where said batches of sheets formed in a prescribed number are removed, and a pusher for pushing said batches of sheets from said table once the table is in said lower position.

7. The apparatus according to claim 6 including means for delivering individually paste applied and folded sheets to said hopper past said counter and conveyor means for receiving batches of sheets pushed by said pusher means.

* * * * *